US006775514B2

(12) United States Patent
Korhonen

(10) Patent No.: US 6,775,514 B2
(45) Date of Patent: Aug. 10, 2004

(54) SUBSTRATE SIZE MONITORING SYSTEM FOR USE IN COPIER/PRINTERS

(75) Inventor: John V. Korhonen, Letchworth (GB)

(73) Assignee: Xerox Corporation, Stamford, CT (US)

( * ) Notice: Subject to any disclaimer, the term of this patent is extended or adjusted under 35 U.S.C. 154(b) by 158 days.

(21) Appl. No.: 10/042,336

(22) Filed: Jan. 11, 2002

(65) Prior Publication Data

US 2003/0133733 A1 Jul. 17, 2003

(51) Int. Cl.[7] ..... G03G 15/00
(52) U.S. Cl. ..... 399/389; 271/171
(58) Field of Search ..... 399/389, 393, 399/13, 370; 271/171, 145; 400/624

(56) References Cited

U.S. PATENT DOCUMENTS 4,475,732 A 10/1984 Clausing et al. ..... 271/10
5,332,208 A * 7/1994 Tsuji et al. ..... 271/171
5,574,551 A * 11/1996 Kazakoff ..... 399/45
5,611,528 A * 3/1997 Nakamura et al. ..... 271/164
5,826,156 A * 10/1998 Natsume et al. ..... 399/389
6,213,659 B1 * 4/2001 Elgee ..... 400/633

FOREIGN PATENT DOCUMENTS

JP 03018530 A * 1/1991 ..... B65H/3/44
JP 05294462 A * 11/1993 ..... B65H/1/00
JP 09221230 A * 8/1997 ..... B65H/1/00
JP 11100134 A * 4/1999 ..... B65H/3/06
JP 2001030589 A * 2/2001 ..... B41J/29/42

* cited by examiner

*Primary Examiner*—Robert Beatty
(74) *Attorney, Agent, or Firm*—W. Henry, III

(57) ABSTRACT

A system to detect if the positions of a tray's sheet guides have been changed while the tray has been open includes a spring loaded stud in the tray that is pushed and locked into an 'in' position every time the tray is pushed in. When the tray is pulled out, if the size guides are moved, the spring-loaded stud is released by a linkage mechanism from the guides to the stud. The stud actuates a sensor flag, and as the tray is pushed home, a sensor checks the flag and a control system subsequently deduces whether the guides have been moved.

6 Claims, 3 Drawing Sheets

SUBSTRATE SIZE MONITORING SYSTEM FOR USE IN COPIER/PRINTERS

BACKGROUND OF THE INVENTION

1. Field of the Invention

This invention relates generally to sheet feeding in copier/printers, and more particularly, to a system for checking for changes in sheet sizes in the paper trays of such machines.

2. Description of Related Art

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the phototconductive member corresponding to the informational areas contained within the original document. After the electrostatic latent image is recorded on the phototconductive member, the latent image is developed by bringing a developer material into contact therewith. Generally, the developer material comprises toner particles adhering triboelectrically to carrier granules to the latent image forming a toner powder image on the photoconductive member. The toner powder image is then transferred from the photoconductive member to a copy sheet. The toner particles are heated to permanently affix the powder image to the copy sheet.

One problem encountered with printers and copiers is unscheduled maintenance calls which can be very costly, and especially, if the unscheduled maintenance calls are initiated by wrong substrate size settings by customers.

After a machine feeds a sheet from a tray, the sheet's travel inside the machine is monitored with paper path sensors that have to be cleared at predetermined times. The time from the sheet's leading edge making a sensor to the trail edge clearing the sensor is nominally the sheet length divided by the transport speed. Obviously, this time is different for different sheet lengths. Machines use predetermined timer values for different sheet lengths and should the sheet length be incorrectly set-up, the result is timing error and machine shutdown. Also, should the sheet's actual width be different from the set-up, the machine will print images, undesirably, to the wrong places.

If the size setting for a tray is incorrect, the machine will shutdown continuously at each feed from the tray and if the customer cannot identify the problem to be a simple, (and possibly self-inflected) set-up mismatch, a maintenance engineer may be called. This could happen when the customer has a full service contract that does not add to the customer's direct costs, but the cost is fully realized by the maintenance engineer's employer.

A number of attempts have been made to ensure the correct sheet size settings in machines. For example, customers are encouraged to set up the sizes through the user interface; or set up the sizes with a special indicator in the trays that is read with sensors; or machines are equipped with automatic size sensing systems where the machine has sensors to detect the positions of substrate guides in a tray and from this deduce the size of substrates in the tray.

U.S. Pat. No. 4,475,732 issued Oct. 9, 1984 to Clausing et al. discloses in FIG. 3 the use of a stack height sensor in a sheet feeding and separating apparatus with the sensor incorporating a plunger having a flag attached to a shoulder thereof that blocks and unblocks an optoelectric sensor as the plunger is moved in a vertical direction.

While the above-mentioned attempts to ensure the correct sheet size settings in machines have been useful, there is still a need for low cost improvements.

SUMMARY OF THE INVENTION

Accordingly, pursuant to the features of the present invention, an improved system to detect if the positions of a tray's sheet guides have been changed while the tray has been open is disclosed that answers the above-mentioned problem by providing a spring loaded stud in the tray that is pushed and locked into an 'in' position every time the tray is pushed in. When the tray is pulled out, if the size guides are moved, the spring-loaded stud is released with a linkage mechanism from the guides to the stud. The stud actuates a sensor flag, and as the tray is pushed home, a sensor checks the flag and a control system subsequently deduces whether the guides have been moved.

These and other features and advantages of the invention are described in or apparent from the following detailed description of the exemplary embodiments.

BRIEF DESCRIPTION OF THE DRAWINGS

The foregoing and other features of the instant invention will be apparent and easily understood from a further reading of the specification, claims and by reference to the accompanying drawings in which like reference numerals refer to like elements and wherein:

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
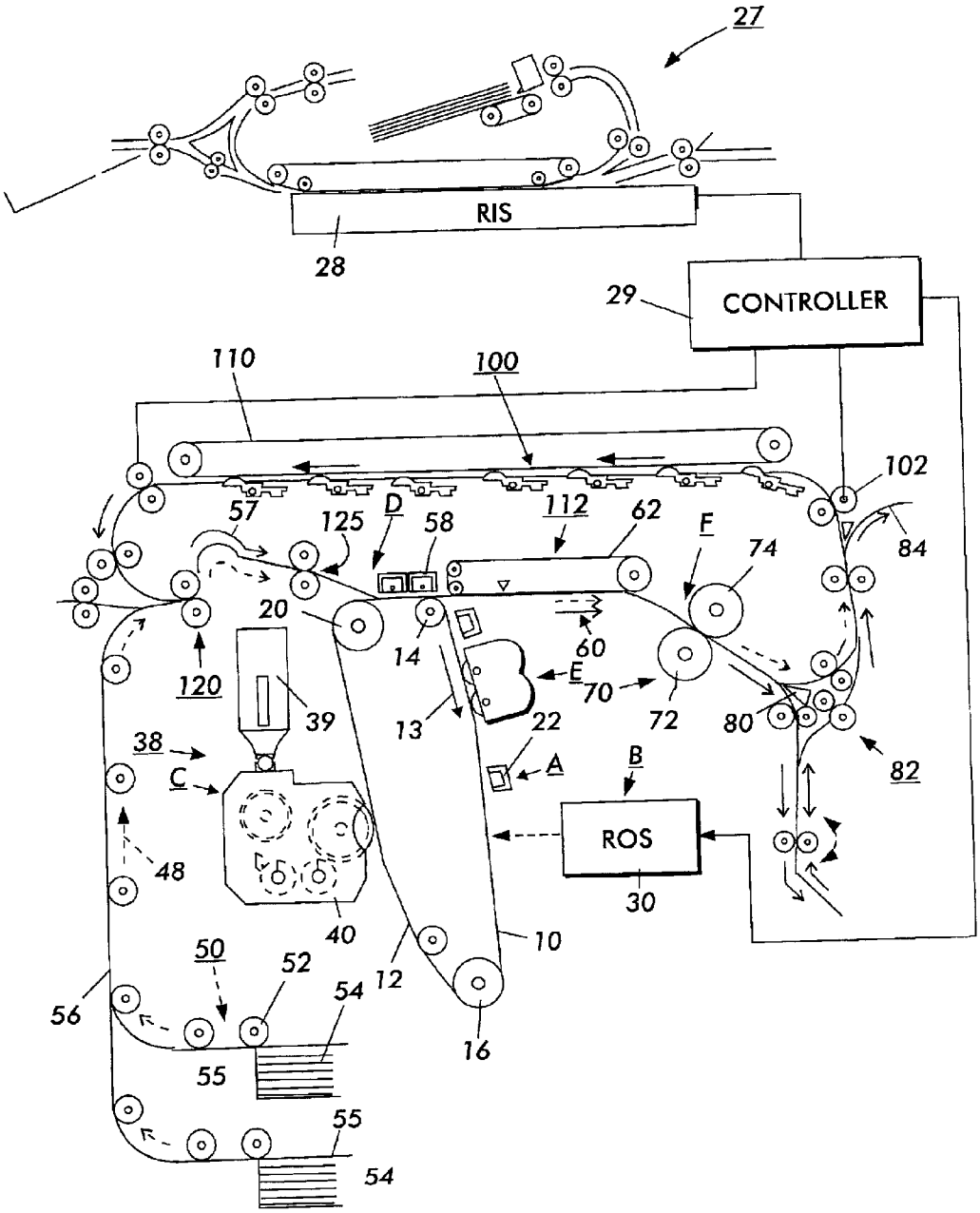
FIG. 1 is a schematic elevational view of a typical electrophotographic printing machine utilizing the substrate size monitoring system of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet size monitoring device of the present invention may be employed in wide variety of devices and in not specifically limited in its application to the particular embodiment depicted herein.

FIG. 1 illustrates an original document positioned in a document handler 27 on a raster input scanner (RIS) indicated generally by the reference numeral 28. The RIS contains document illumination lamps; optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine, which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photocondctive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example a raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted the latent image using commonly known techniques. The latent image attracts toner particle from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56 from tray one of similar trays 55. Vertical transport 56 directs the advancing sheet 48 of support material into registration transport 125 past image transfer station D to receive an image from photoreceptor belt 10 in a timed sequence so that the toner powder image formed thereon contacts the advancing sheet 48 at transfer station D. Transfer station D includes a corona generating device 58, which sprays ions onto the backside of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roll 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor, which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
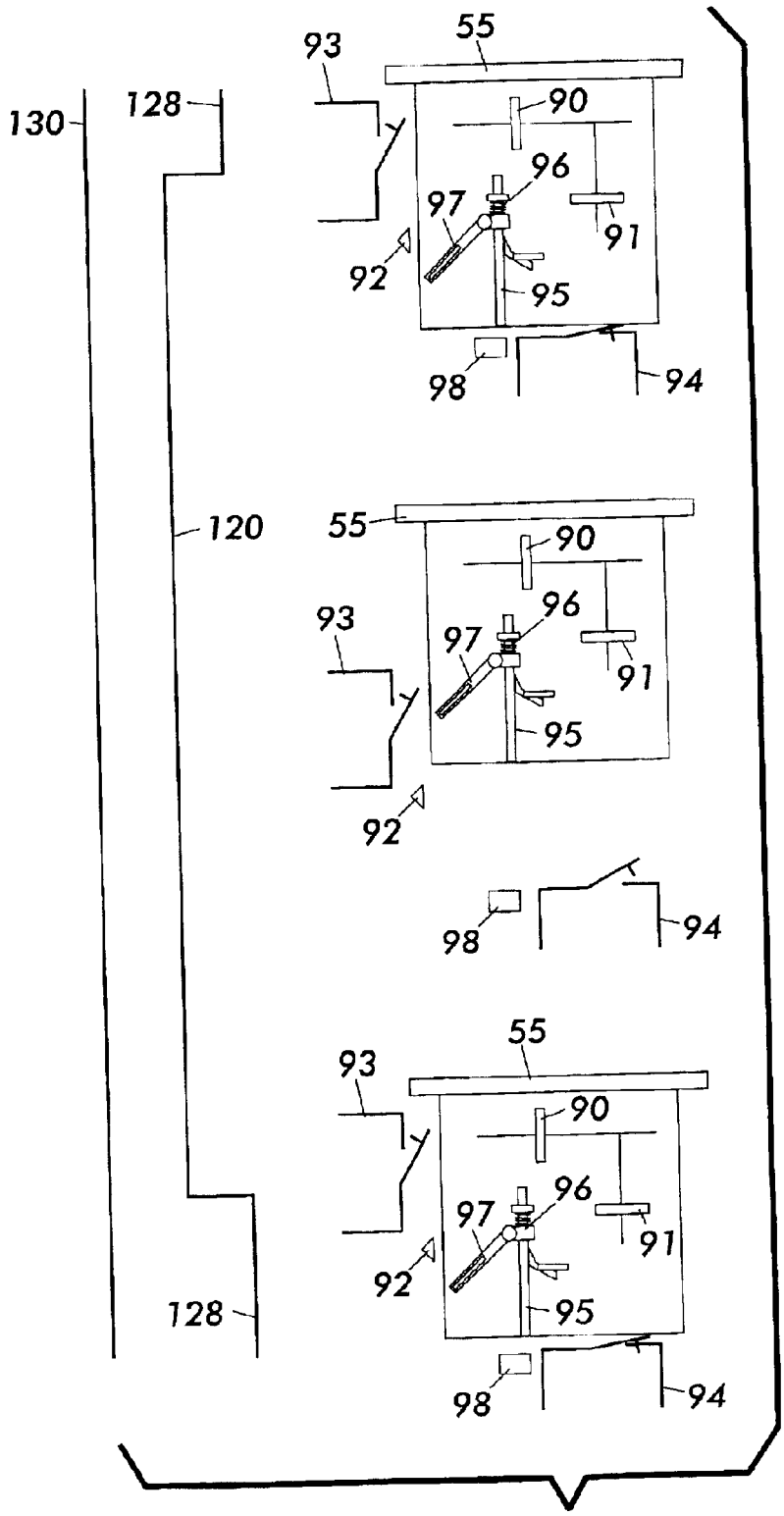
FIG. 2 is a partial schematic plan view of a paper tray shown in FIG. 1 showing the tray in a closed, open and closed position when sheet size is not adjusted.

Turning next to FIG. 2, a detailed illustration of the substrate size monitoring system of the present invention is illustrated showing a fray 55 in an initially closed position as indicated by tray home signal line 120 and is bracketed by machine guides 93 and 94. A sensor 92 is positioned below machine guide 93 and is in communication with controller 29 to give off a change of direction signal 130. Tray 55 includes side guide 90 and 91 that are adjusted in accordance with the size of substrates or sheets placed into the tray. Tray 55 also includes a stud 95 loaded by spring 96. Stud 95 has a flag 97 attached thereto, such that, movement of the stud causes the flag to rotate in a clockwise or counter-clockwise direction.

As shown in FIG. 2, Tray 55 is initially in a home position as indicated by tray home signal 128. As the tray is pulled out from the machine the tray home signal 128 is changed as indicated by line 120 and after the tray is returned to the home position the tray home signal is back at 128. In FIG. 2, side guides 90 and 91 have not been adjusted and flag 97 does not cover sensor 92 during withdrawal or insertion of tray 55 into the machine. This is indicated by change detection signal 130 being in a straight line continuously during movement of the tray.

Figure 3:
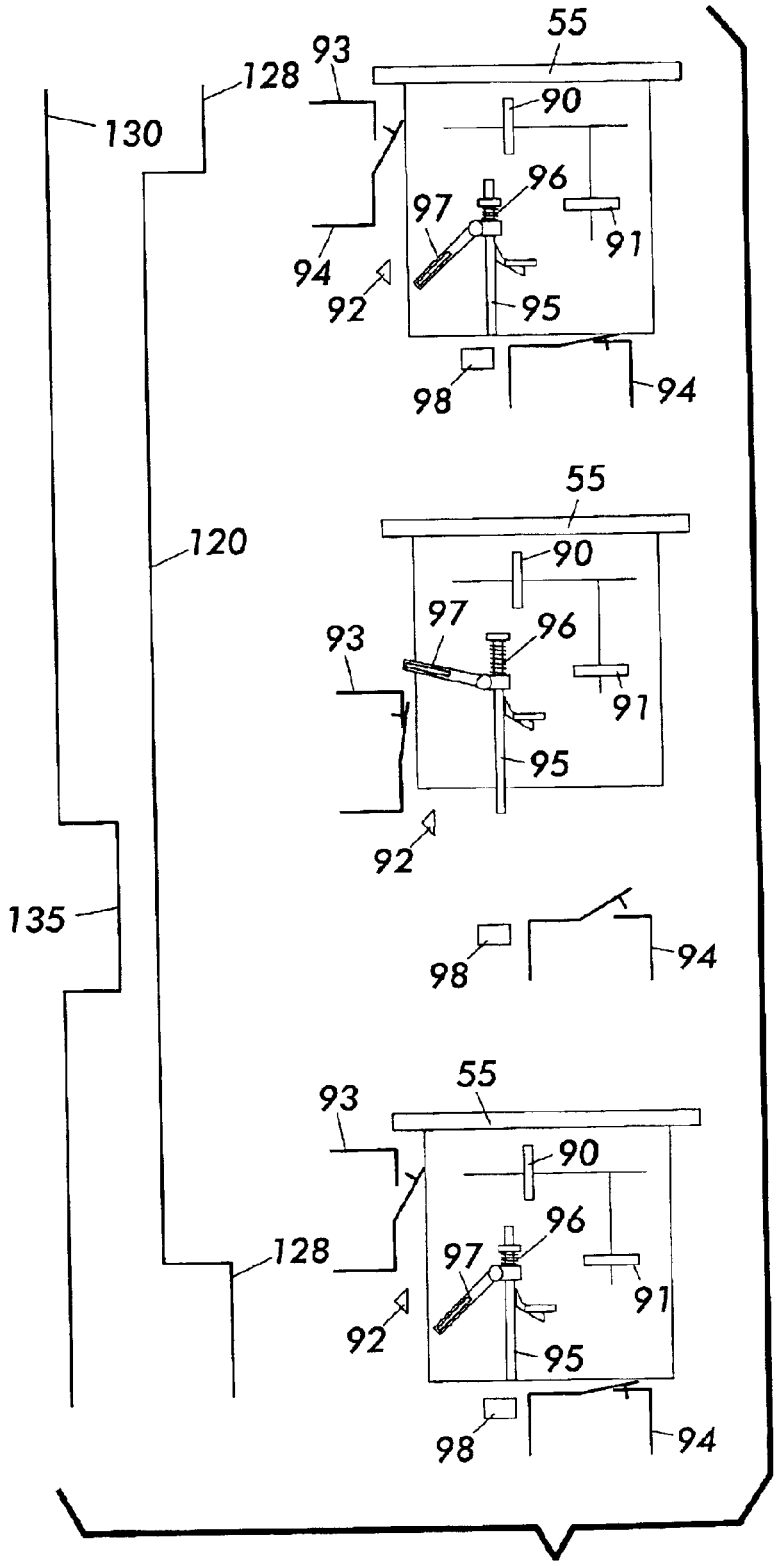
FIG. 3 is a partial schematic plan illustration of a paper tray in FIG. 1 showing the tray in a closed, open and closed position when sheet size is adjusted.

In FIG. 3, Tray 55 is in a home position as indicated by tray home signal 128 with side guides 90 and 91 set for the substrate size already in the tray. The tray is moved out and side guides 90 and 91 are set for substrates of a different dimension. Side guides 90 and 91 are connected to spring loaded stud 95 through a conventional linkage mechanism (not shown) such that as the side guides are adjusted the stud is released and thereby rotating flag 97 in a counter-clockwise direction. As the tray is pushed back into the machine, flag 97 makes sensor 92 which gives off a change detection signal indicated at 135 and controller 29 subsequently deduces whether the guides have been moved. Once the machine, through controller 29, knows that the side guides have been adjusted it sends a signal to the machine's user interface and the customer is requested to set-up the size and prohibit usage of the tray unless the size is set. Continued movement of tray 55 into its home position causes stud 95 to hit stationary member 98 and reset to its home position.

Should a customer fail to set-up the size correctly, the substrate size monitoring system of the present invention will help the service engineer to interrogate the situation better using remote inactive diagnostics, possibly eliminating the need for a site visit. This system also enables the customer to solve more problems by using the user interface.

In conclusion, disclosed is a paper tray that includes spring-loaded mechanism that can be in one of two positions. The mechanism is released whenever paper tray adjustments are made. The released mechanism triggers a sensor forcing a dialogue on the user interface, forcing the user to select the paper size, thereby avoiding jams. The sensor is triggered and the mechanism is latched as the paper tray is inserted.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A system for monitoring the size of substrates in a tray that includes a pair of side guides adjustable to accommodate a variety of substrate sizes, comprising:

a stud member connected to said tray and adapted to be actuated by movement of said side guides;

an arm member connected to and adapted to be moved by said stud member;

a sensor adapted to sense the presence of said arm member and give off a signal; and a controller, said controller adapted to receive a signal from said sensor and in turn indicate to a user interface that said side guides have been adjusted.

2. The system of claim 1, wherein said stud is spring loaded.

3. A system in a printer/copier for ensuring the proper size setting for substrates in a tray, comprising:

a substrate tray adapted for movement from a home position to an open position, and wherein said substrate tray includes a pair of adjustable guides;

a latch mechanism, said latch mechanism including a stud having a flag attached thereto and adapted to move in clockwise and counter-clockwise directions upon movement of said stud, and wherein movement of said adjustable guides triggers said latch mechanism to release said stud and thereby rotate said flag in a clockwise direction;

a sensor adapted to sense the presence of said flag; and a controller adapted to receive a signal from said sensor and in turn signal a user interface of said machine.

4. The system at claim 3, wherein movement of said tray toward said home position causes said flag to cover said sensor with said sensor sending a signal to said controller indicating adjustment of said guides.

5. The system of claim 4, wherein said stud abuts a stationary member when said tray is returned to said home position.

6. The apparatus of claim 3, wherein said stud is spring loaded.

* * * * *